US005178818A

United States Patent [19]

Ikoma et al.

[11] Patent Number: 5,178,818

[45] Date of Patent: Jan. 12, 1993

[54] METALLURGICAL FURNACE INSTALLATION

[75] Inventors: Hiroaki Ikoma, Osaka; Shigemitsu Fukushima, Tokyo, both of Japan

[73] Assignee: Mitsubishi Materials Corporation, Tokyo, Japan

[21] Appl. No.: 794,937

[22] Filed: Nov. 20, 1991

[30] Foreign Application Priority Data

Nov. 20, 1990 [JP] Japan ..... 2-314680

[51] Int. Cl.[5] ..... C21B 7/14

[52] U.S. Cl. ..... 266/196; 266/231

[58] Field of Search ..... 266/45, 196, 231

[56] References Cited

U.S. PATENT DOCUMENTS 1,995,941 3/1935 Pugh ..... 266/196
3,365,187 1/1968 French et al. ..... 266/196
3,689,252 9/1972 Osborne et al. ..... 266/196
3,890,139 6/1975 Suzuki et al. .
3,901,489 8/1975 Suzuki et al. .

*Primary Examiner*—Melvyn J. Andrews
*Attorney, Agent, or Firm*—Oblon, Spivak, McClelland, Maier & Neustadt

[57] ABSTRACT

A metallurgical furnace installation is disclosed which includes a metallurgical furnace for holding a metal melt therein, a melt launder, and a drain launder. The furnace has an outlet for discharging the melt and a drain hole for draining the melt remaining in the furnace. The drain hole is formed at a bottom of the furnace so as to be openable and closable. The melt launder has one end connected to the outlet of the furnace and is inclined downwardly in a direction away from the furnace, whereby the melt in the metallurgical furnace is tapped therethrough toward the other end. The drain launder has one end connected to the drain hole and the other end connected to the melt launder, and is inclined from the one end toward the other end, whereby the drained melt flows therethrough into the melt launder.

2 Claims, 4 Drawing Sheets

METALLURGICAL FURNACE INSTALLATION

BACKGROUND OF THE INVENTION

1. Field of the Invention

The present invention relates to a metallurgical furnace installation and particularly to the improvement of the drainage structures for discharging the melt remaining in the furnace when operations are suspended.

2. Prior Art

As schematically depicted in FIGS. 1 and 2, a continuous copper smelting installation comprised of a plurality of metallurgical furnaces is hitherto known. The smelting installation comprises a smelting furnace 1 for melting and oxidizing the copper concentrates supplied together with oxygen enriched air, to produce a mixture of matte M and slag S, a separating furnace 2 for separating the matte M from the slag S, a converter or converting furnace S for oxidizing the separated matte M into blister copper C and slag, and launders 4 for defining melt passageways to bring the furnaces into fluid communication with one another. The smelting furnace 1, the separating furnace 2 and the converting furnace 3 are arranged so as to be at different elevations in descending order, so that the melt flowing out from the outlet 5 of each furnace may be tapped via gravity through the launder 4. Furthermore, in each of the smelting furnace 1 and the converting furnace 3, lances 6 each composed of a double-pipe structure are inserted through the furnace roof and attached thereto to be vertically movable, and copper concentrates, oxygen enriched air, flux, cold charge, and so on are supplied into each furnace through these lances 6. The separating furnace 2 is an electric furnace equipped with electrodes 7. The blister copper C produced in the converting furnace 3 is transferred to anode furnaces (not shown) and is there refined into copper of higher purity.

In the smelting installation as described above, it is necessary to drain the melt remaining in the metallurgical furnace when operations are suspended for maintenance of the furnace. Therefore, the smelting furnace 1 or the converting furnace 3, for example, is provided with an openable and closable drain hole 8 to which a drain launder 9 is connected. Thus, the drain hole 8, which is kept closed during regular operation, is opened upon the suspension of the operation, whereby the melt remaining in the furnace is discharged through the drain hole and the launder. After being cooled and solidified, the discharge is granulated and recycled to the furnace through the lances 6.

Thus, in the conventional furnace installation, the melt drained from the metallurgical furnace must be appropriately treated before introducing it into the furnace again, and an excessive labor is required for this treatment. In addition, the generation of flue gas during the treatment of the melt may adversely affect the environment.

SUMMARY OF THE INVENTION

It is therefore an object and feature of the present invention to provide a novel metallurgical furnace installation which does not require the treatment of the drained melt and which can avoid adverse effects on the environment.

According to the invention, there is provided a metallurgical furnace installation comprising:

a metallurgical furnace for holding a metal melt therein, the metallurgical furnace having an outlet for discharging the melt and a drain hole for draining the melt remaining in the metallurgical furnace, the drain hole being formed at a bottom of the metallurgical furnace so as to be openable and closable;

a melt launder having one end connected to the outlet of the metallurgical furnace and being inclined downwardly in a direction away from the metallurgical furnace, whereby the melt in the metallurgical furnace is tapped therethrough toward the other end: and a drain launder having one end connected to the drain hole and the other end connected to the melt launder, the drain launder being inclined from the one end toward the other end, whereby the drained melt flows therethrough into the melt launder.

DESCRIPTION OF PREFERRED EMBODIMENTS OF THE INVENTION

Figure 1:
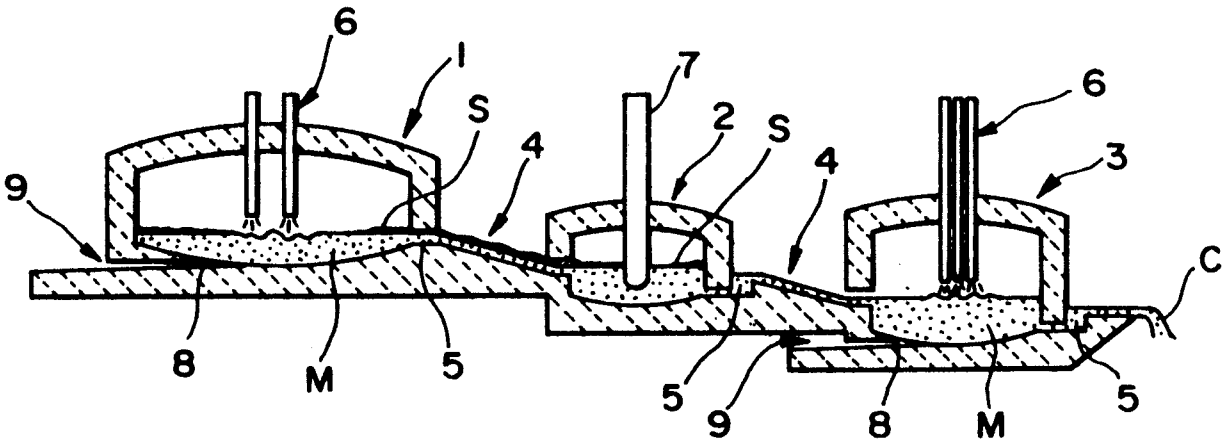
FIG. 1 (PRIOR ART)
FIG. 1 is a schematic cross-sectional view of a conventional continuous copper smelting installation.
Figure 2:
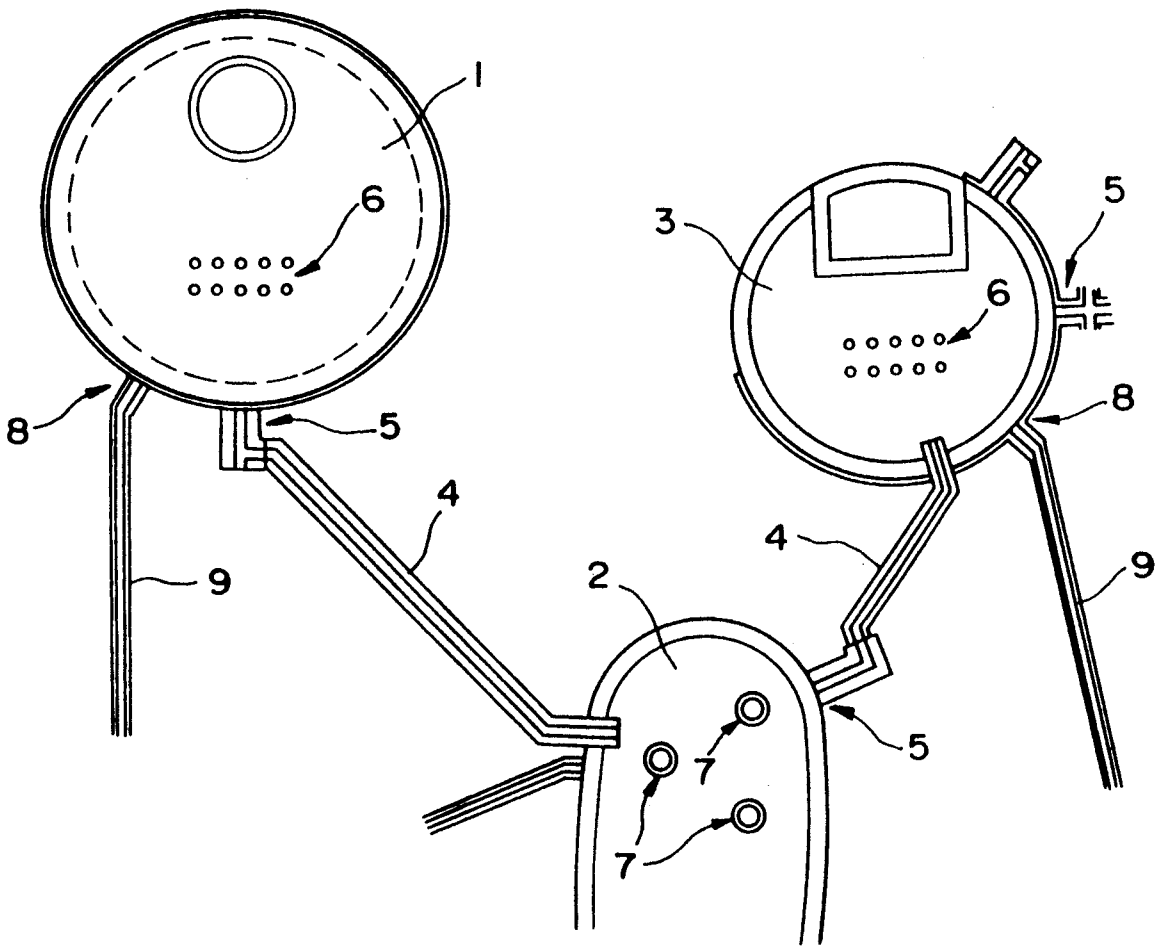
FIG. 2 is a schematic plan view of the installation of FIG. 1.
Figure 3:
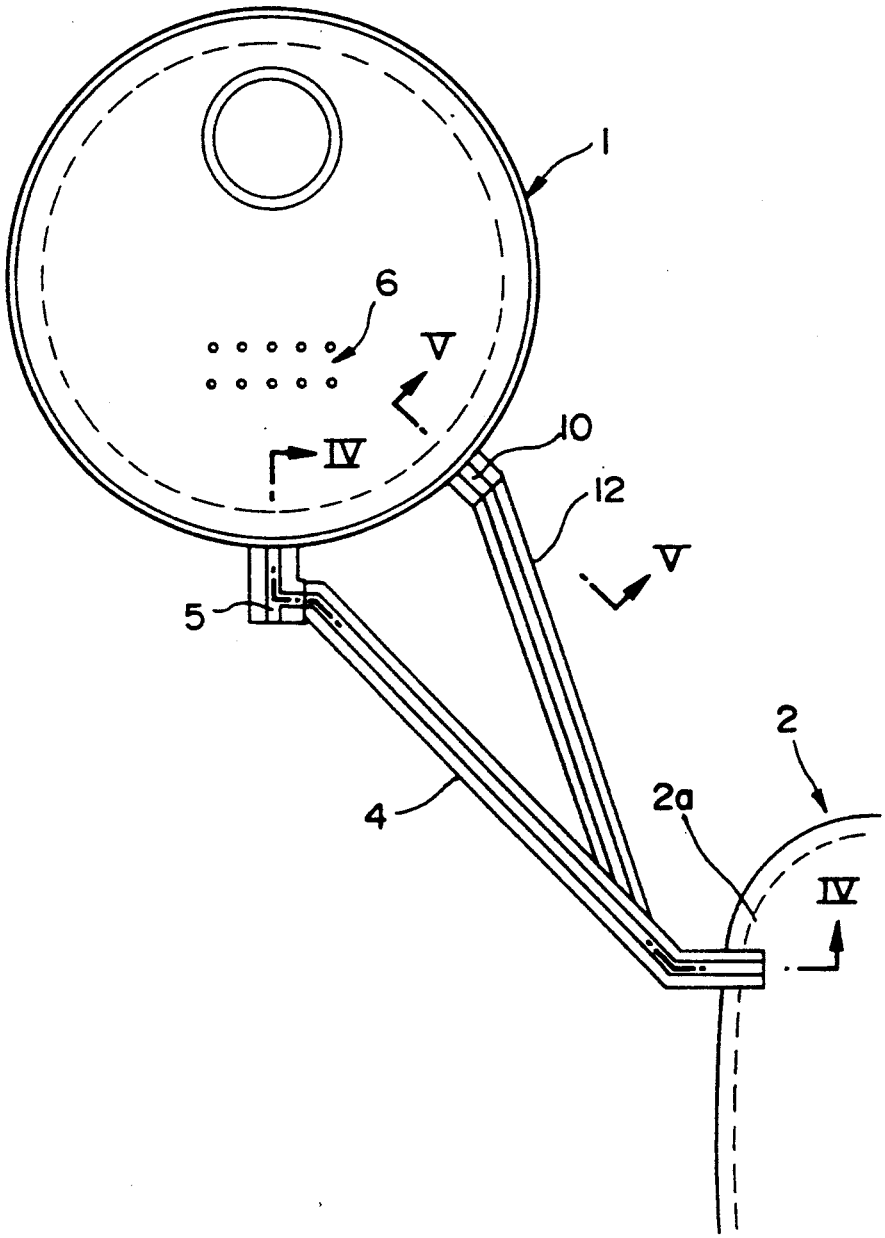
FIG. 3 is a plan view of a metallurgical furnace installation in accordance with the present invention.
Figure 4:
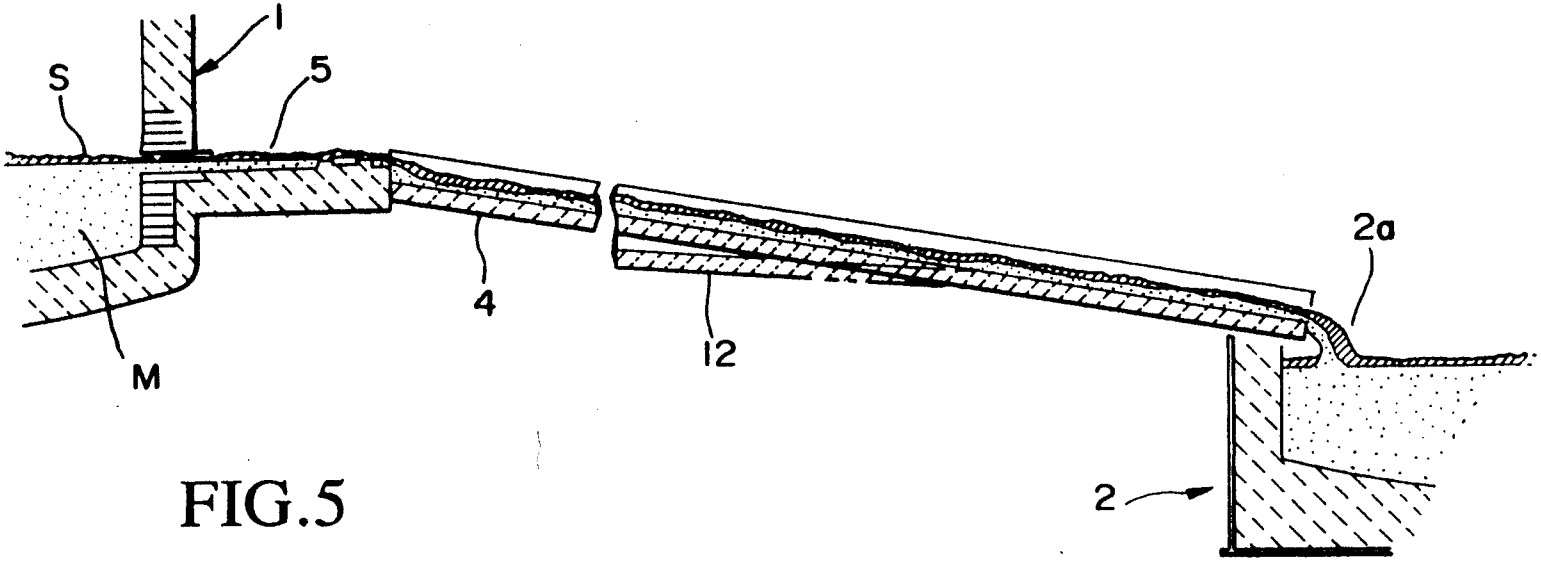
FIG. 4 is a cross-sectional view of the apparatus of FIG. 3 taken along the line IV—IV in FIG. 3.
Figure 5:
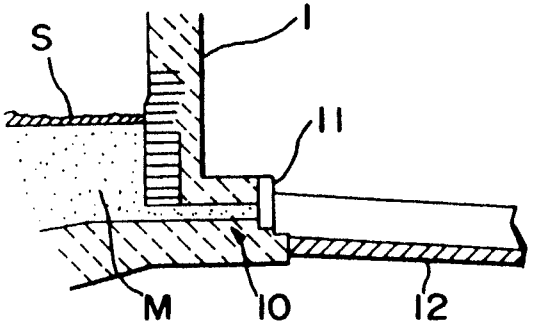
FIG. 5 is a cross-sectional view taken along the line V—V in FIG. 3.

FIGS. 3 to 5 depict a metallurgical furnace installation in accordance with an embodiment of the present invention in which the parts or members common with those in FIGS. 1 and 2 are designated by the same characters.

In the illustrated embodiment, a smelting furnace 1 has an outlet B for discharging a mixture of matte and slag and a drain hole 10 for draining the melt remaining in the furnace. A separating furnace 2 has an inlet 2*a* for receiving the mixture of matte M and slag S transported from the smelting furnace 1. A melt launder 4 is connected at one end to the outlet 5 of the smelting furnace 1, and the other end of the melt launder 4 is disposed at the inlet 2*a* of the separating furnace 2. The melt launder 4 is inclined downwardly in a direction away from the smelting furnace 1 toward the separating furnace 2, so that the mixture of matte M and slag S produced in the smelting furnace 1 is tapped therethrough into the separating furnace 3. The drain hole 10 is formed through the side wall of the smelting furnace 1 at its bottom in such a manner that its elevation is lower than that of the outlet 5. The drain hole 10 is openable and closable by a sealing member 11 removably disposed thereat, and the melt is prevented from flowing out by the member 11 during the regular operation. In the foregoing, the smelting furnace 1 is arranged such that its bottom is higher than the level of the inlet 2*a* of the separating furnace 2.

Furthermore, a drain launder 12 is connected at one end thereof to the drain hole 10, and the other end of the drain launder 12 is connected to the melt launder 4. The drain launder 10 is inclined from one end toward the other end, so that the drained melt flows therethrough into the melt launder 4, which serves as a melt passageway during the regular operation.

When draining the melt remaining in the smelting furnace 1 during the suspension of operation, the other end of the drain launder 12 is first connected to a downstream portion of the melt launder 4. The connection of the drain launder 12 to the melt launder 4 may be carried out by removing a part of a side wall of the melt launder 4, and placing another connecting launder of a suitable length between the drain launder 12 and the melt launder 4. Alternatively, the other end of the drain launder 12 may be formed in an elongated manner so as to reach the melt launder 4, and the connection of the drain launder 12 may be carried out by removing a part of the side wall of the launder 4 when necessary.

When the connection of the drain launder 12 to the melt launder 4 is thus completed, the drain hole 10 provided at the smelting furnace 1 is then opened by removing the sealing member 11. This removal operation may be performed, for example, by heating the sealing member 11 with a burner or the like to melt it away. When the drain hole 10 is opened, the melt remaining in the furnace is caused to flow out through the drain launder 12 into the melt launder 4, and further through the melt launder 4 into the separating furnace 2.

As described above, in the present invention, the drained melt, which in the prior art was recycled to the furnace after being cooled, solidified, and granulated, can instead be directly transported by the drain launder 12 to the next metallurgical furnace while being maintained in a molten state. Therefore, the labor that has been required for the treatment of the melt residual can be substantially reduced.

Furthermore, in the present invention, since treatment of the drained melt is not necessary, the flue gas which would have been generated during the treatment of the melt will not be produced, and hence the adverse affection of the drainage of residual melt on the environment can be avoided.

In the above embodiment, the improvement in the drainage structure for the metallurgical furnace is contemplated for a smelting furnace in a continuous copper smelting installation. However, the drainage structure as described above may be applied to other furnaces in the continuous copper smelting installation or to furnaces in other metallurgical installations.

Obviously many modifications and variations of the present invention are possible in the light of the above teachings. It is therefore to be understood that within the scope of the appended claims, the invention may be practiced otherwise than as specifically described.

What is claimed is:

1. A metallurgical furnace installation comprising:

a first metallurgical furnace for holding a metal melt therein, said metallurgical furnace having an outlet for discharging the melt and a drain hole for draining the melt remaining in said metallurgical furnace, said drain hole being formed at a bottom of said metallurgical furnace so as to be openable and closable;

a melt launder having one end connected to said outlet of said metallurgical furnace and being inclined downwardly in a direction away from said metallurgical furnace, whereby the melt in the metallurgical furnace is tapped therethrough toward the other end;

a drain launder having one end connected to said drain hole and the other end connected to said melt launder, said drain launder being inclined from the one end toward the other end, whereby the drained melt flows therethrough into said melt launder; and a second metallurgical furnace having an inlet, the other end of said melt launder being disposed at said inlet of said second metallurgical furnace, said inlet of said second metallurgical furnace having an elevation lower than the bottom of the first-mentioned metallurgical furnace.

2. A metallurgical furnace installation as recited in claim 1, further comprising a sealing member removably disposed at said drain hole for opening and closing the drain hole.

* * * * *